US005413222A

United States Patent [19]

Holder

[11] Patent Number: 5,413,222

[45] Date of Patent: May 9, 1995

[54] METHOD FOR SEPARATING A PARTICULAR METAL FRACTION FROM A STREAM OF MATERIALS CONTAINING VARIOUS METALS

[76] Inventor: Morris E. Holder, P.O. Box 9283, Chattanooga, Tenn. 37412-9283

[21] Appl. No.: 184,651

[22] Filed: Jan. 21, 1994

[51] Int. Cl.[6] ..... B07C 5/344

[52] U.S. Cl. ..... 209/567; 209/570; 209/639

[58] Field of Search ..... 209/567, 570, 639, 644

[56] References Cited

U.S. PATENT DOCUMENTS 3,701,419 10/1972 Hutter et al. ..... 209/567 X
4,373,638 2/1983 Schapper ..... 209/570
4,848,590 7/1989 Kelly ..... 209/639 X

FOREIGN PATENT DOCUMENTS 1588859 4/1970 France ..... 209/567

*Primary Examiner*—David H. Bollinger

*Attorney, Agent, or Firm*—David J. Hill

[57] ABSTRACT

A method is disclosed for separating a preselected metal fraction from a stream of discrete particles containing a plurality of metals that are not strongly ferromagnetic. According to this method, a detection zone is established within the stream of particles, and a static magnetic field is established within the detection zone. The static magnetic field so established is of insufficient strength or flux density to induce in the particles of metal in the stream an opposing magnetic field of such strength as to cause the particles in the stream to move. The presence of a particle within the detection zone is detected, and changes in the magnetic flux density of the field are measured as the particle passes through the detection zone. The changes so measured are then compared with a predetermined change pattern for the preselected metal fraction to be removed, and the particles whose passage through the detection zone change the magnetic flux density of the field according to the predetermined change pattern are separated from the stream.

20 Claims, 5 Drawing Sheets

METHOD FOR SEPARATING A PARTICULAR METAL FRACTION FROM A STREAM OF MATERIALS CONTAINING VARIOUS METALS

FIELD OF THE INVENTION

This invention relates generally to the separation and classification of materials which are not strongly ferromagnetic, and in particular to the separation and classification of a preselected fraction of metals from mixture containing metals which are not strongly ferromagnetic, and non-metals. The invention is particularly useful, for example, in the separation and recovery of such metals from municipal solid waste material including automobile scrap.

DESCRIPTION OF THE PRIOR ART

In the processing of waste materials for reclamation and recycling, it is desirable to separate the various fractions of a mixture of several types of materials. In processing solid municipal waste and automobile scrap, the initial step usually taken is to shred the waste and scrap into materials of a manageable size. Screening of the shredded material for oversized particles is also common, where the oversized material so removed is returned to the shredder. A stream of shredded material of a suitable size fraction is then conveyed to a conventional air classifier for removal of the lightweight fraction of materials, such as for example, paper. The remaining stream of heavy-fraction materials may be passed through a conventional magnetic separator where materials containing high concentrations of strongly ferromagnetic metals (those of high magnetic permeability), such as iron, cobalt and nickel, are removed. The materials which remain in the stream then include dielectric materials such as plastic, rubber, wood and glass, and non-magnetic metals, including metals which are ferromagnetic but not strongly so such as stainless steel and chrome-plated zinc (which contains nickel), and nonferromagnetic, nonferrous metals such as aluminum, copper, lead and zinc.

As used herein, non-magnetic metals are to be distinguished from magnetic metals, which may be classified as those metals which have magnetic. permeabilities such that an attractive force may be developed between the magnetic metals and a magnetic field such that the gravitational attraction between the metal and the Earth may be overcome. As so distinguished, non-magnetic metals are therefore incapable of being removed from a mixture or stream containing various types of materials by magnetic attraction to a strong permanent magnet or electromagnet.

A number of methods have been developed for separating the electrically conductive metals from a stream of dielectric and non-magnetic materials. Most of these methods utilize the principle of electromagnetic eddy-current repulsion.

An electromagnetic force (emf) is induced in an electrically conductive material that is moved through or relative to a magnetic field. When an emf is induced within such a material, a flow of electrons within the material results. This current, called an eddy current, has a magnetic field associated with it, which magnetic field exerts a repulsive force on the first magnetic field. If the first magnetic field has a sufficiently high field strength, and is created by a fixed permanent magnet or electromagnet so that the field is static, and the conductive material is free to move with respect thereto, the material in which the eddy current is induced will be repelled from the static magnetic field. The repulsive force will vary directly with the magnitude of the induced eddy currents, which in turn will depend upon the gradient of the static magnetic field (or the change in its flux density) which is encountered by the conductive material moving relative thereto, and the electrical conductivity of the material, as well as on the size and shape of the material.

In most of the methods used for separating metals in a non-magnetic solid stream, a mixture of particles of materials having various electrical conductivities and magnetic properties is passed through a static magnetic field which has a high field strength. In accordance with the well-known principles described above, the particles in the mixture of greater conductivity will generally be deflected from their path to a greater extent than will those of lesser conductivity. As a result, the particles emerging from the field may have different trajectories, depending on their differing conductivities, and a separation based on these differing conductivities may be achieved.

However, as has been previously mentioned, the repulsive or deflecting forces created by induced eddy currents in particles in a high-field-strength magnetic field will also depend on particle size and shape, as well as on the electrical conductivity of the particles. Therefore, small particles having relatively high electrical conductivity may be repelled or deflected into the same trajectory as larger particles having a lower conductivity. Furthermore, particles of similar size which are comprised of the same material may nevertheless be repelled or deflected into different trajectories if they are influenced by the static magnetic field at different locations, because the field strength or flux density of the static magnetic field is not constant across the region wherein it will induce eddy currents in electrically conductive particles. Finally, particles of similar size, which are comprised of different materials which nevertheless have similar conductivities, such as, for example, aluminum arid stainless steel, cannot be separated from each other by a conventional eddy-current-repulsion separation method.

Because of these limitations which are inherent in the conventional induced-eddy-current-repulsion separation method, several variations of this well-known method for separating and classifying non-magnetic materials have been developed.

Several of these methods utilize various techniques to control the trajectories of separation taken by materials which are subjected to induced eddy-current repulsion. Thus, for example, U.S. Pat. No. 4,069,145 of Sommer, Jr. et al. describes a variation of a conventional eddy-current-repulsion separation method according to which the path of the feedstream into the magnetic field is controlled in order to influence the subsequent path of deflection. U. S. Pat. No. 4,842,721 of Schloemann describes a variation of the conventional method in which the force of gravity is utilized in partial opposition to the repulsive force acting on the particles to be separated in order to influence the path of deflection. Both the method of U.S. Pat. No. 5,057,210 of Julius and that of U. S. Pat. No. 5,080,234 of Benson utilize an arrangement of a rotating magnetic rotor with other elements (Benson's arrangement includes two such rotors) to control the path of deflection taken by materials which are subjected to induced-eddy-current repulsion.

Another variation from the conventional method is described in U.S. Pat. No. 5,064,075 of Reid. This method operates by controlling the flux density of the magnetic field to which the feedstream of materials is exposed in order to induce eddy-current repulsion in a portion of the materials which has been preselected according to shape or size.

Each of these methods may avoid or overcome some of the limitations of conventional eddy-current-repulsion separation; however, each remains subject to certain of the limitations of the conventional method. Thus, for example, the methods of Sommer, Jr. et al., Julius, Benson and Reid do not avoid the problem of small particles having relatively high electrical conductivity being repelled or deflected into the same trajectory as larger particles having a lower conductivity. Furthermore, none of the aforementioned methods except that of Sommer Jr. et al. addresses the problem of particles of similar size that are comprised of the same material entering the region of influence of the magnetic field at locations of differing flux density such that the eddy currents, and hence the repulsive forces, which are induced are of sufficiently differing magnitude to deflect or repel the particles into different trajectories. Finally, none of these methods can be used to separate from each other particles of similar size which are comprised of different materials which nevertheless have similar conductivities.

Some of the variations from the conventional method for separating materials by eddy-current-repulsion impose additional limitations upon the conventional method, or require a pretreatment or prescreening process to be carried out on the feedstream materials before eddy-current-repulsion is induced.

Thus, for example, both the method of U.S. Pat. No. 5,060,871 of Brassinga et al. and that of U.S. Pat. No. 5,133,505 of Bourcier et al. are limited to application to a mixture of aluminum alloys. The method of Brassinga et al., which may be utilized to separate aluminum-lithium alloy particles from a mixture of wrought aluminum alloys, requires a heating and crushing pretreatment of the feedstream. The method of Bourcier et al., which may be used to separate aluminum alloys having different electrical conductivities, requires that the feedstream of alloys be prescreened according to particle size so that only particles of similar size are subjected to induced eddy currents.

The methods of Brassinga et al. and Bourcier et al., fail to provide for separation of particles of different sizes and conductivities which may nevertheless be subject to similar repulsive forces, as well as for separation of particles of similar size which are comprised of different materials having similar conductivities. Furthermore, these methods do not avoid or overcome the problem of particles of similar size and comprised of the same material being subjected to differing repulsive forces because they encounter the magnetic field at different locations.

As can be appreciated from the foregoing discussion, the several variations to the conventional eddy-current-repulsion separation method that are now in use are all nevertheless subject to some of the problems and limitations inherent in the conventional eddy-current-repulsion separation method.

U.S. Pat. No. 4,718,559 of Kenny et al. discloses a different sort of method for separation of nonferrous metallic particles from a mixture of such particles, ferrous metallic particles and non-metallic particles. This method does not employ a magnetic field to induce eddy currents in the particles to create a repelling force acting on certain of the particles to move them out of the feedstream. Instead, the method of Kenny et al. utilizes a tuned phase detector circuit to measure a decrease in inductance in the detector coil in response to the proximity of nonferrous particles. Upon detection of such. decreased inductance, an air valve is actuated to remove such particles from the feedstream. While avoiding some of the problems inherent in a conventional eddy-current-repulsion separation method, the method of Kenny et al. is nevertheless subject to limitations and problems of its own. It is well-known that a tuned phase detector circuit is inherently unstable, and consequently subject to falling out of tune. This problem would seem especially difficult to overcome in a typical recycling or scrap-yard environment, where vibrations of various frequencies from conveyors, shredders, vibratory feeders arid the like, are inevitable. Furthermore, tuned phase detector circuits are also susceptible to temperature variations within the range of normal ambient conditions.

Therefore, as can be seen from the foregoing discussion, although several methods have been developed for use in separating a preselected fraction of metals from a mixture of metals and (in some cases) non-metals, all are subject to various limitations and disadvantages.

OBJECTS AND ADVANTAGES OF THE INVENTION

Accordingly, it is an object of the invention claimed herein to provide a method for separating a preselected metal fraction from a stream of solid particles containing various metals and non-metals, while avoiding the disadvantages and limitations of previously-known methods. It is therefore an object of this invention to provide a separation method which operates according to principles that do not include induced eddy-current repulsion or tuned phase detector circuits.

More particularly, it is an object of this invention to provide a method for separating a preselected metal fraction from a stream of materials that may include a variety of metals that are not strongly ferromagnetic. It is another object of this invention to provide a separation method that can be successfully used to separate a preselected metal fraction from a stream or mixture of materials which includes particles of different sizes and conductivities, as well as from a stream of materials which includes particles of similar size which are comprised of different materials that nevertheless have similar conductivities. It is yet another object of this invention to provide a method that can be successfully used to separate materials which are not strongly ferromagnetic, such as stainless steel and chrome-plated zinc, from a stream or mixture of materials. It is still another object of this invention to provide a separation method for successfully removing nonferrous, nonferromagnetic materials from a stream or mixture of materials. It is yet another object of this invention to provide a separation method that can be successfully utilized to remove a particular preselected metal from a stream or mixture of materials. Additional objects and advantages of this invention will become apparent from an examination of the drawings and the ensuing description.

SUMMARY OF THE INVENTION

A method is disclosed for separating a preselected metal fraction from a stream of discrete particles containing a plurality of metals that are not strongly ferromagnetic. According to this method, a detection zone is established within the stream of particles, and a static magnetic field is established within the detection zone. The static magnetic field so established is of insufficient strength or flux density to induce in the particles of metal in the stream an opposing magnetic field of such strength as to cause the particles in the stream to move. The presence of a particle within the detection zone is detected, and changes in the magnetic flux density of the field are measured as the particle passes through the detection zone. The changes so measured are then compared with a predetermined change pattern for the preselected metal fraction to be removed, and the particles whose passage through the detection zone change the magnetic flux density of the field according to the predetermined change pattern are separated from the stream.

In order to facilitate an understanding of the invention, an apparatus in which the method may be practiced is illustrated in the drawings, and a detailed description of the preferred embodiments of the method follows. It is not intended, however, that the invention be limited to the particular embodiments described or to use in connection with the apparatus shown. Various changes are contemplated such as would ordinarily occur to one skilled in the art to which the invention relates.

DESCRIPTION OF THE PREFERRED EMBODIMENTS OF THE INVENTION

Figure 1:
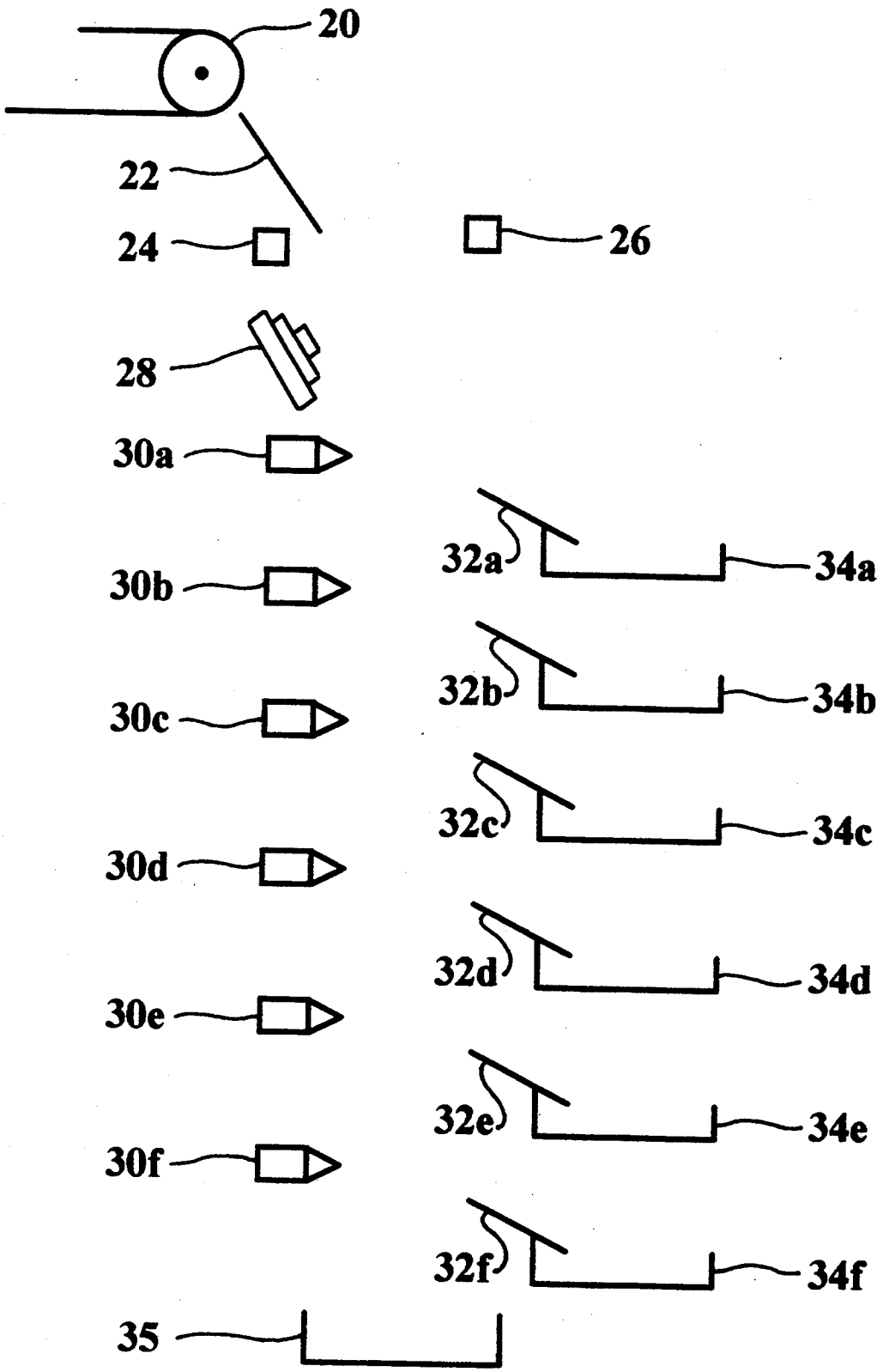
FIG. 1 is a schematic illustration of a portion of an apparatus that may be used in the practice of a preferred embodiment of the invention.

FIG. 1 illustrates a portion of the apparatus that may be utilized in the operation of a preferred embodiment of the invention. This apparatus may be particularly adaptable for use in connection with the reclamation or recycling of solid waste materials, including automobile scrap, such as may be carried out at a commercial recycling center or a municipal waste processing facility.

It is preferable to prepare the solid waste materials which are to be fed into the apparatus of the preferred embodiment of the invention by first shredding the materials in a conventional shredder in order to reduce them to a manageable size. Screening of the shredded material for oversized particles may also be carried out and the oversized material so removed may be returned to the shredder. A stream of shredded material of a suitable size fraction may then be conveyed to a conventional air classifier for removal of the lightweight fraction of materials, such as for example, paper. The remaining stream of heavy-fraction materials may be passed through a conventional magnetic separator where materials containing high concentrations of strongly ferromagnetic metals (those of high magnetic permeability), such as iron, cobalt and nickel, are removed. The materials remaining in the stream may be fed from a vibratory feeder onto a conveyor for transport to the separator apparatus that operates according to the principles of this invention. Use of such a feeder will distribute the materials more or less evenly on the conveyor.

Such pretreatments of the stream of materials to be processed according to this invention are preferred and will likely increase the efficiency with which the invention may be operated, although none of these pretreatments of the material are required for successful identification and separation of a preselected metal fraction according to the method of this invention. However, if the feedstream contains significant portions of strongly ferromagnetic materials of significant size, such materials may be magnetically attracted to the magnet which is utilized in the operation of the invention so as to block or impede the stream of materials to be processed for separation.

The materials which remain in the stream after the preferred pretreatment may include dielectric materials such as plastic, rubber, wood and glass, and non-magnetic metals, including metals which are ferromagnetic but not strongly so such as stainless steel and chrome-plated zinc (which contains nickel), and nonferromagnetic, nonferrous metals such as aluminum, copper, lead and zinc.

As illustrated in FIG. 1, a mixture or stream of discrete particles containing a plurality of metals that are not strongly ferromagnetic (not shown) may be conducted from any pretreatment stage which is employed in connection with a preferred embodiment of the invention by conveyor 20. This conveyor may be of any convenient width, such as, for example, 24 inches, and it may be operated at speeds such as are well-known and commonly used in conventional recycling systems. The stream of discrete particles is transported by conveyor 20 to slide 22, which is arranged to receive the mixture of particles as they are conveyed off of the end of conveyor 20. Slide 22 constrains the particles from rolling or tumbling as it conveys the stream of particles to the detection zone of the invention. This will increase the accuracy of the changes measured in the magnetic flux density of the magnetic field as the particles pass through the detection zone, as will be more particularly described subsequently.

Slide 22 is preferably comprised of a nonferromagnetic material, such as aluminum or plastic, in order to avoid adversely affecting the magnetic field distribution of the invention. Furthermore, slide 22 is preferably furnished with a smooth finish and disposed at a relatively steep angle to the horizontal, in order that the speed of the stream of particles from conveyor 20 will not be significantly diminished as the particles move down the slide. Slide 22 is preferably comparable in width to conveyor 20, and it may be fitted with sidewalls (not shown) in order to restrain the particles in the stream from falling off the slide before they are conducted to the detection zone.

As the particles in the stream reach the lower end of slide 22 in the embodiment of FIG. 1, they will encounter a conventional infrared sensor, comprised of infrared emitter 24 and infrared detector 26, which elements are arranged so that the stream of particles cuts through the infrared beam between emitter 24 and detector 26. A plurality of infrared sensors may be employed across the width of slide 22, depending on the desired separation accuracy and on the volume of the stream. It is not necessary, of course, that the sensor utilized to detect the presence of a particle be an infrared sensor. Any proximity sensor may be utilized, but an infrared sensor has been found to provide preferred results.

Figure 2:
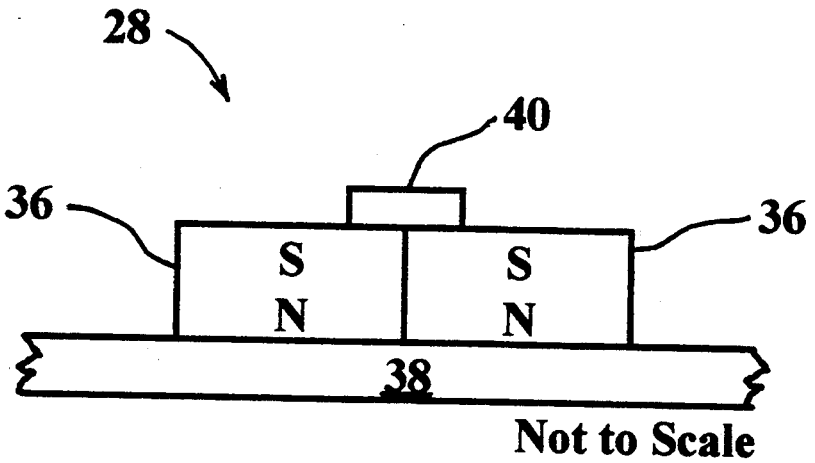
FIG. 2 is a schematic illustration of a preferred embodiment of the magnetic-field assembly of the apparatus of FIG. 1.

Associated with the infrared sensor of FIG. 1, and located adjacent to the stream of particles is magnetic-field assembly 28, which is illustrated in greater detail by FIG. 2. FIG. 2 is a front view of the detail of magnetic-field assembly 28, a side view of which is shown in FIG. 1 shown in FIG. 2, a preferred embodiment of assembly 28 is comprised of a plurality of permanent magnets 36 (two of which are shown), a backing plate 38 and a conventional Hall-effect sensor 40. Each of magnets 36 has associated with it a North polarity face and an opposite South polarity face, as illustrated in FIG. 2. Magnets 36 are preferably rare-earth magnets, and particularly good results have been obtained in the practice of the invention by a use of neodymium magnets. Such magnets can be utilized to create a static magnetic field having a field strength of about 1200 gauss in the vicinity of the Hall-effect sensor. As used herein, the term "static" means that the magnetic field established according to the invention is fixed in location relative to the detection zone. The stream of particles may move through the detection zone, or the detection zone, with its static magnetic field, may move with respect to the stream.

The static magnetic field established according to this invention should be of insufficient strength to induce in the particles of metal in the stream or mixture an opposing magnetic field of such strength as to cause the particles in the stream to move. Thus, although eddy currents will be induced in any electrically-conductive particle which passes through the static magnetic field within the detection zone, the field strength of the magnetic field established should not be so strong that the eddy currents induced, and the resulting repulsive magnetic field, will cause the particle to move with respect to the static magnetic field.

Backing plate 38 is preferably comprised of a strongly ferromagnetic or high-magnetic-permeability material such as mild steel. In a preferred embodiment of the invention, a plurality of magnets 36 are arranged in close proximity on the backing plate, which extends across the width of slide 22. The North pole surface of each of the magnets will be magnetically attracted to the backing plate, although the same surface will also be repelled from the nearby North pole surfaces of adjacent magnets. The attraction of the backing plate will be stronger than the repulsion of adjacent magnets, so that the magnets will tend to remain in place on the backing plate. However, it is preferable that the magnets also be mechanically affixed to the backing plate so that they will not be subject to shifting in position with respect to each other.

It has been found that the preferred embodiment illustrated by FIG. 2, wherein a plurality of magnets 36 are arranged in close proximity to each other on a backing plate of high-magnetic-permeability material, will produce a magnetic field of higher field strength than would be expected from an examination of the field strengths of the magnetic fields created separately by the individual magnets. The number of magnets utilized in the preferred embodiment should be sufficient to extend across the width of the slide, so as to create a magnetic field of overlapping components within and across the detection zone.

A Hall-effect sensor is a transducer that may be utilized to measure the magnitude of a change in the magnetic flux density of a magnetic field. In the practice of this invention, very small changes in magnetic flux density are measured, on the order of less than 1 gauss. It is not necessary that a Hall-effect sensor be employed. Any magnetic flux density detection or measuring device that can detect or measure changes of such magnitude may be utilized. In the practice of a preferred embodiment of this invention, Hall-effect sensor 40 operates continually to detect and measure or read the magnetic flux density of the static magnetic field created by magnets 36 in its vicinity. By detecting changes in the magnetic flux density of the field in its vicinity, the Hall-effect sensor can be utilized to detect the presence of any particle which enters the region of influence of the field and causes a change in the magnetic flux density of the field. However, the preferred practice of the invention utilizes the infrared sensor of FIG. 1, comprised of emitter 24 and detector 26, to detect the presence of a particle in the detection zone. Upon such detection, analysis of the information obtained by the Hall-effect sensor can begin. Preferably, the infrared sensor and Hall-effect sensor 40 are arranged so that the infrared sensor will trigger analysis of the information obtained by the Hall-effect sensor for a predetermined period of time. Thus, it can be seen that the region in the vicinity of the Hall-effect sensor, wherein the Hall-effect sensor can be utilized to detect and measure the magnetic flux density of the field upon detection of the presence of a particle by the infrared sensor, comprises the detection zone.

As shown in FIG. 2, Hall-effect sensor 40 is preferably mounted atop permanent magnets 36 using an adhesive or other convenient means. Preferably, the Hall-effect sensor is located within a distance of approximately 1.5 centimeters from the stream of particles near the centerline of the static magnetic field with which it is associated. A plurality of Hall-effect, sensors, each associated with an infrared sensor, may be employed across the width of slide 22, depending on the desired separation accuracy and on the volume of the stream of materials to be separated by the invention. Excellent separation results have been obtained where the infrared sensor and Hall-effect sensor pairs have been spaced approximately 2.5 centimeters apart across the width of the slide.

Figure 3:
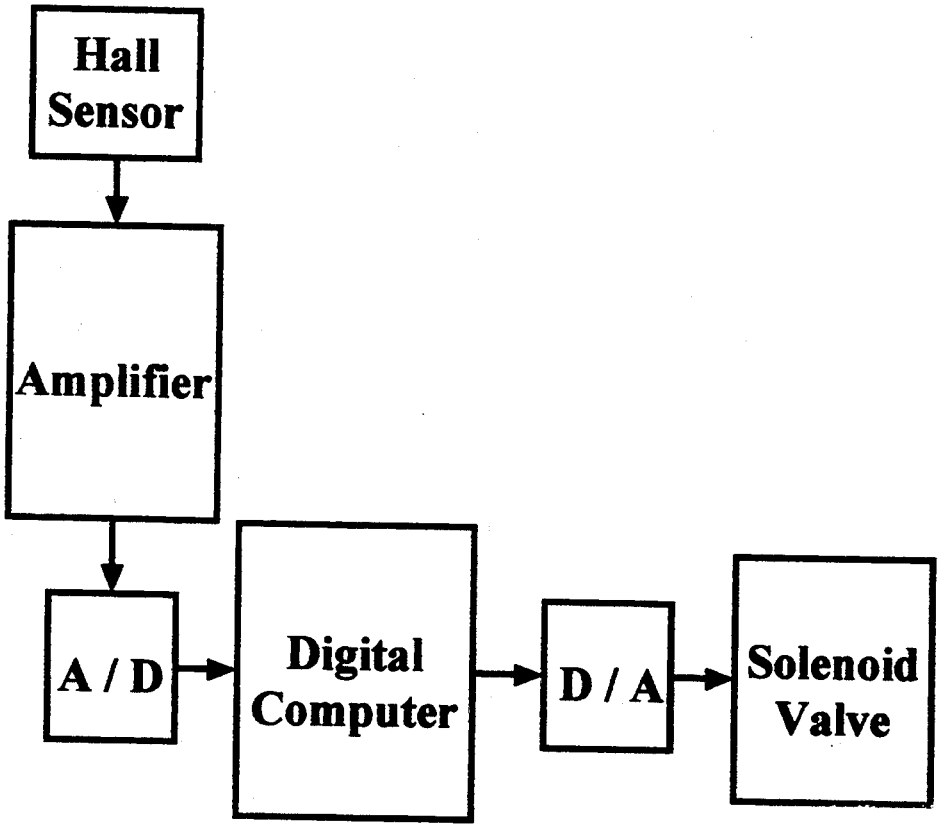
FIG. 3 is a schematic illustration of a portion of an apparatus that may be used in the practice of the preferred embodiment of FIG. 1.
Figure 4:
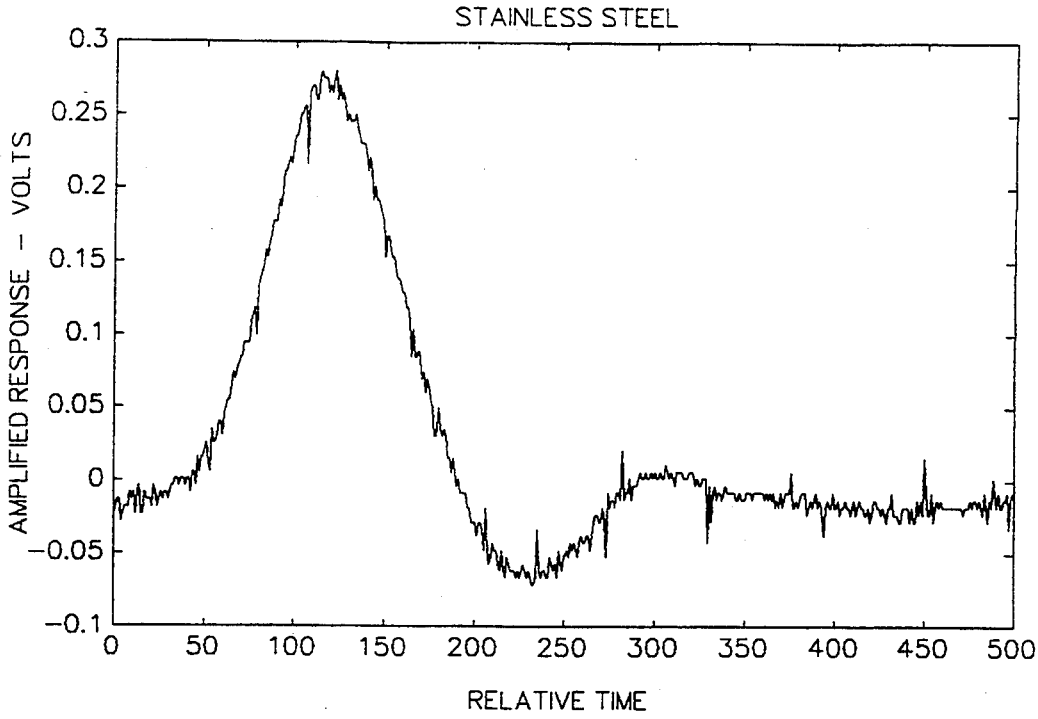
FIG. 4 is an illustration of the pattern of change of the magnetic flux density of the static magnetic field which is utilized in the operation of the invention for separation of a particular sample of stainless steel.
Figure 5:
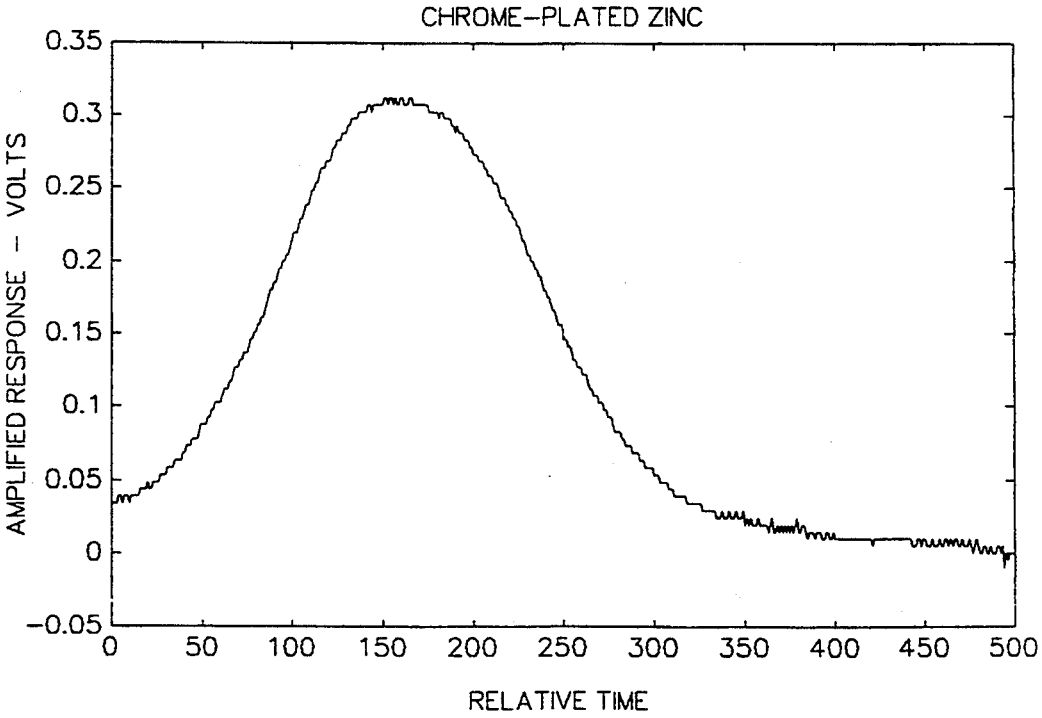
FIG. 5 is an illustration of the pattern of change of the magnetic flux density of the static magnetic field which is utilized in the operation of the invention for separation of a particular sample of chrome-plated zinc.
Figure 6:
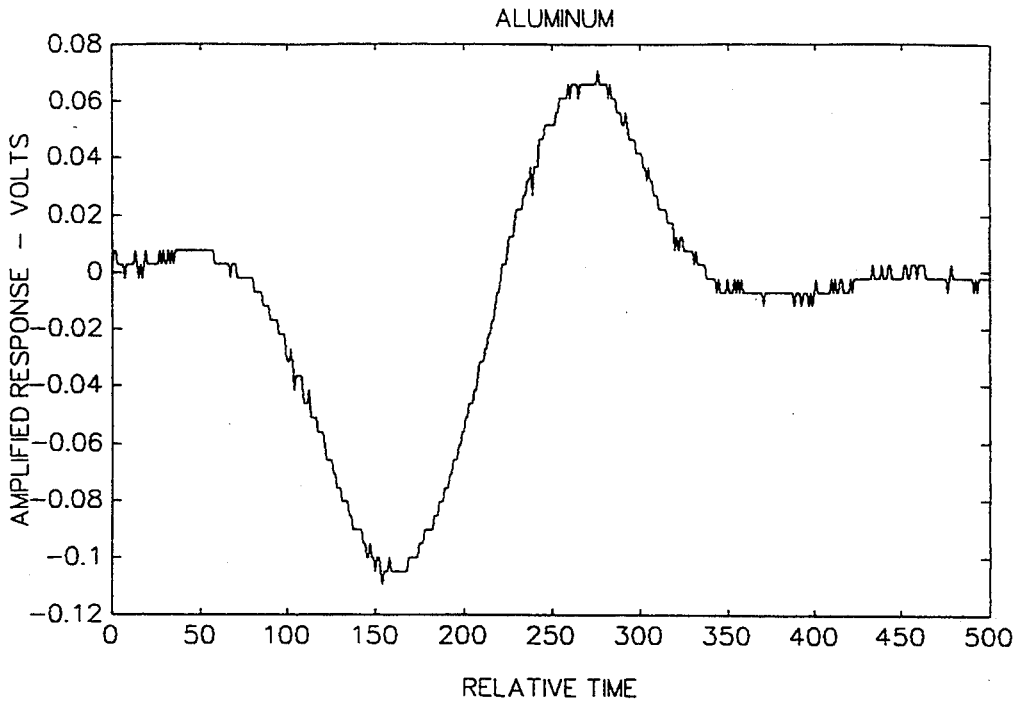
FIG. 6 is an illustration of the pattern of change of the magnetic flux density of the static magnetic field which is utilized in the operation of the invention for separation of a particular sample of aluminum.
Figure 7:
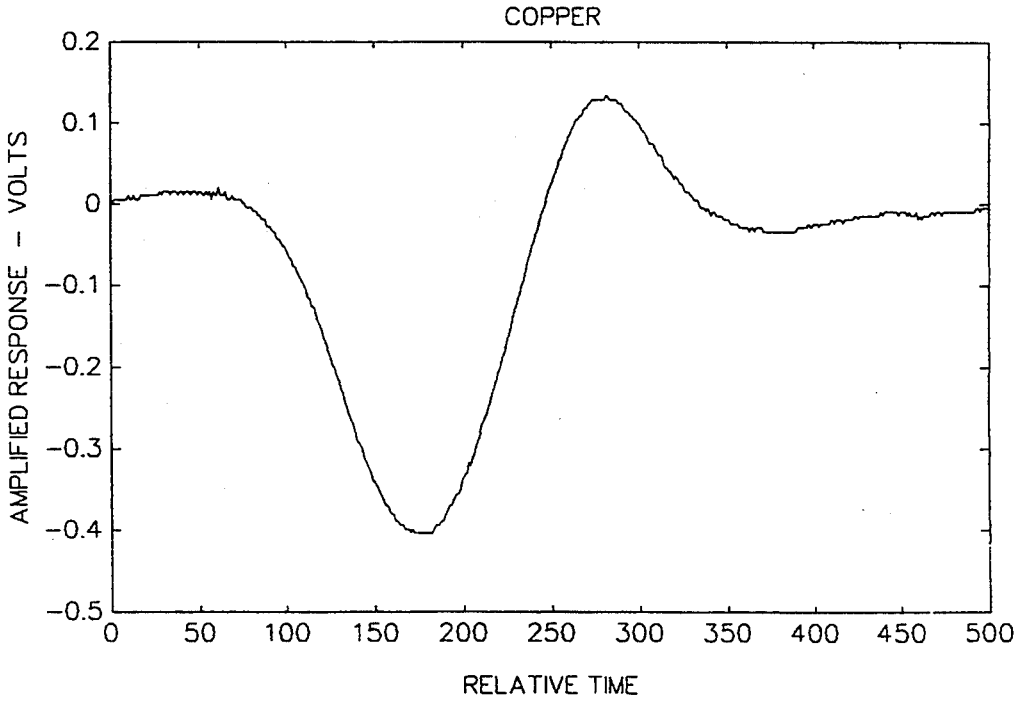
FIG. 7 is an illustration of the pattern of change of the magnetic flux density of the static magnetic field which is utilized in the operation of the invention for separation of a particular sample of copper.
Figure 8:
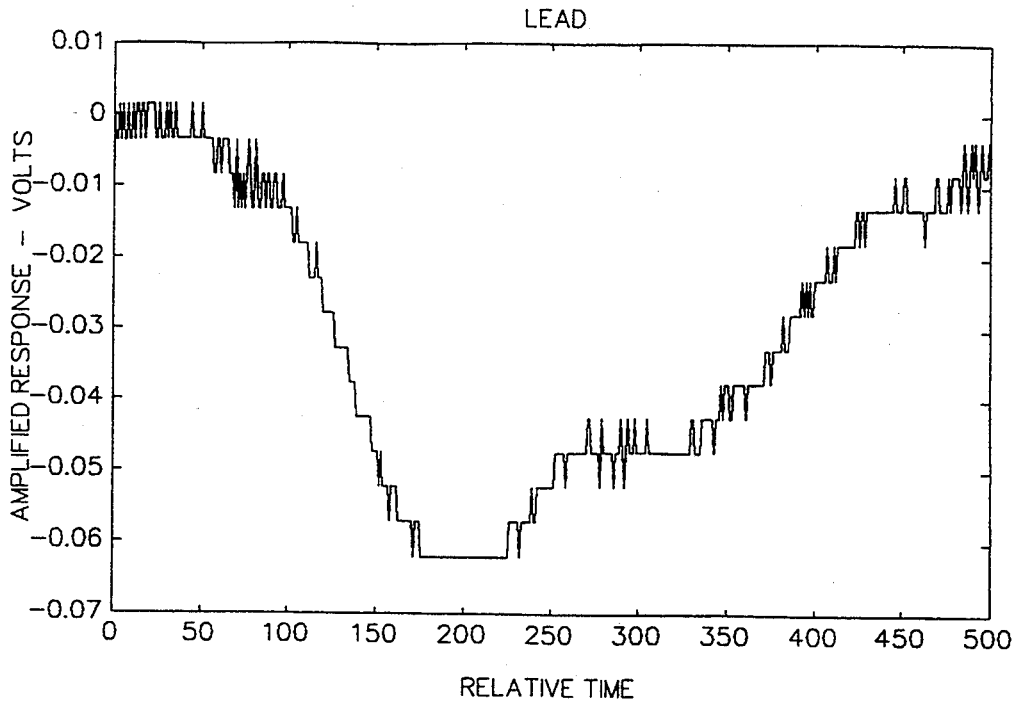
FIG. 8 is an illustration of the pattern of change of the magnetic flux density of the static magnetic field which is utilized in the operation of the invention for separation of a particular sample of lead.
Figure 9:
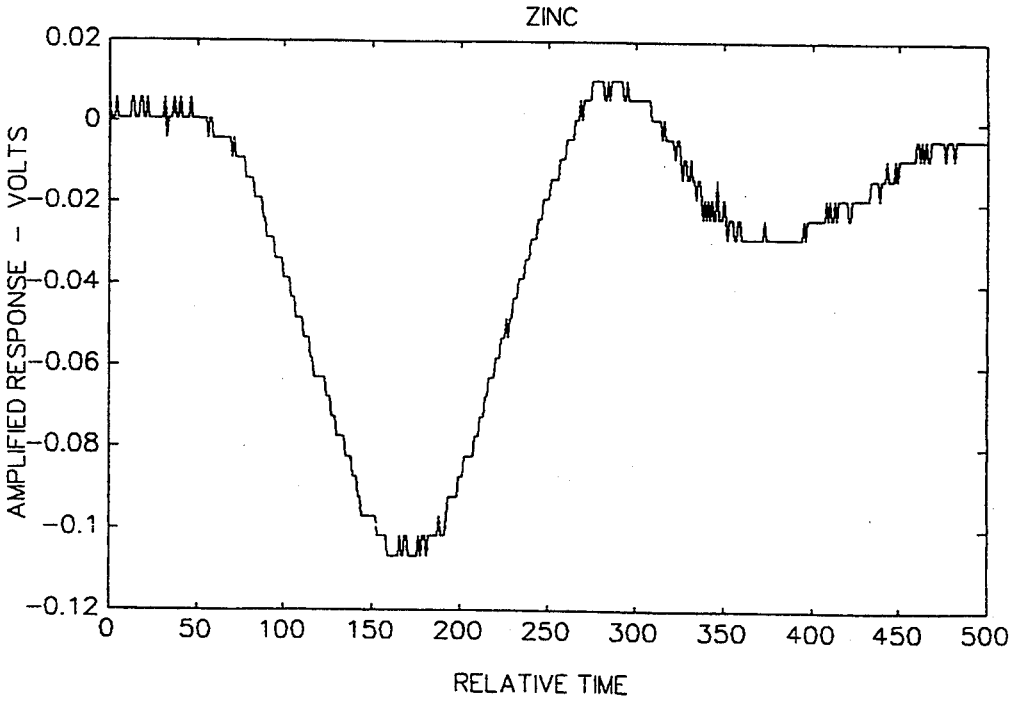
FIG. 9 is an illustration of the pattern of change of the magnetic flux density of the static magnetic field which is utilized in the operation of the invention for separation of a particular sample of zinc.

FIG. 3 illustrates a portion of an apparatus that may be employed along with the Hall-effect sensor of FIG. 2 in the practice of the preferred embodiment of FIG. 1. When a particle passes through the detection zone, the Hall-effect sensor will read or measure the magnetic flux density of the static magnetic field during the time of the particle's passage. Thus, it measures the changing magnetic flux density of the field as the particle passes through the detection zone. In the practice of a preferred embodiment of this invention, a Hall-effect sensor which produces an output signal of about 0.45 millivolts/gauss is utilized. As shown in FIG. 3, the Hall-effect sensor converts the magnetic flux density readings to voltages, which are then amplified by use of a conventional voltage amplifier. In the practice of a preferred embodiment of this invention, the output signals of the Hall-effect sensor are amplified about 2600 times. The amplified voltages are converted from analog to digital form by a conventional analog/digital (A/D) converter, and the digital signal so produced is input into a digital computer. The digital computer compares the change in the magnetic flux density measured by the Hall-effect sensor as a particle passed through the detection zone with a predetermined change pattern for the preselected metal fraction which is to be removed from the stream or mixture of materials by utilization of the invention. The computer also controls the mechanism by which removal of the preselected metal fraction from the stream is accomplished.

The response of the Hall-effect sensor to the passage of an electrically conductive particle through the magnetic field within the detection zone is affected by the angle of approach of the particle to the magnetic field. This angle can be adjusted where necessary, by changing the relative orientation of the Hall-effect sensor, the magnets and the path followed by the particles, to accommodate the particular installation wherein the invention is employed. It is important to realize, however, that the shape of the change pattern measured for a particular particle will vary somewhat as the angle of approach is changed.

If a dielectric particle passes through the detection zone, its passage will not appreciably affect the magnetic flux density of the static magnetic field, as measured by the Hall-effect sensor. However, any electrically conductive particle will affect the magnetic flux density upon passage through the static magnetic field within the detection zone. Eddy currents will be induced in such particles, which eddy currents will create a magnetic field that will change the magnitude of the magnetic flux density of the static magnetic field as the particle passes through the detection zone.

A nonferromagnetic, nonferrous metallic particle, such as one comprised chiefly of aluminum, copper, lead or zinc, will change the magnetic flux density of the field primarily by reducing its magnitude as the particle enters the field and while the particle is within the field, until the particle passes the centerline of the field. Thereafter, as the particle continues to pass through the field, the magnitude of the magnetic flux density will tend to increase. During the time of passage of the particle through the magnetic field, therefore, the magnitude of the magnetic flux density, as measured by a Hall-effect sensor, will reach its minimum value before it reaches its maximum value.

In contrast, the passage through the magnetic field within the detection zone of a ferromagnetic particle, even a weakly ferromagnetic particle, such as one comprised chiefly of stainless steel or chrome-plated zinc, will have a markedly different effect on the flux density. The higher magnetic permeability of the ferromagnetic particle will cause an increase in the magnetic flux density of the field in the vicinity of the particle, which increase will overwhelm any reduction in the flux density of the field caused by induced eddy currents. Therefore, the magnitude of the magnetic flux density of the field will reach its maximum value before it reaches its minimum value during the time of passage of a ferromagnetic particle through the magnetic field within the detection zone.

If it is desired to separate a preselected metal fraction comprised of ferromagnetic metals from a stream or mixture of particles according to the preferred embodiment of FIG. 3, the digital computer will analyze the digital signal received from the Hall-effect sensor for each particle detected in the detection zone to determine if the magnetic flux density of the field reached its maximum value before it reached its minimum value as the particle passed through the magnetic field within the detection zone. If, on the other hand, it is desired to separate a preselected metal fraction comprised of nonferromagnetic, nonferrous metals from the stream, the digital computer will analyze the digital signal received from the Hall-effect sensor for each particle detected in the detection zone to determine if the magnetic flux density of the field reached its minimum value before it reached its maximum value as the particle passed through the detection zone.

The invention may also be utilized to separate a particular metal from a stream or mixture of discrete particles. In addition to the change patterns for ferromagnetic, and for nonferromagnetic, nonferrous metals that have been described hereinbefore, the invention can also be utilized to identify the particular change pattern associated with a particular metal. FIGS. 4–9 illustrate change patterns measured according to the invention for samples of stainless steel, chrome-plated zinc, aluminum, copper, lead and zinc respectively. The x-axis of the graph of each of these figures shows the relative time during which the particle was seen to change the magnetic flux density of the magnetic field as it passed through the detection zone. The units of the x-axis represent the number of data points that were analyzed while the particle was passing through the detection zone. The y-axis shows the amplified response, in volts, obtained from the Hall-effect sensor, indicating the change in the magnetic flux density of the field as the particle passed through the detection zone. All of the change patterns of FIGS. 4–9 were obtained by utilizing the preferred embodiment of FIG. 1, wherein the angle of approach of the particles was at right angles to the centerline of the magnetic field. The particular samples utilized in obtaining the change patterns illustrated by FIGS. 4 and 5 were common pieces of automobile scrap measuring approximately $4.0\times1.25\times0.5$ centimeters. The particular samples utilized in obtaining the change patterns illustrated by FIGS. 6–9 were all approximately the same size: $5.0\times2.5\times0.6$ centimeters. Furthermore, all of the samples utilized in obtaining the change patterns illustrated by FIGS. 4–9 were oriented so that their long axis was at right angles to the direction of travel of the particles through the detection zone.

Although all ferromagnetic metals, for example, will exhibit the change pattern described herein for such materials, wherein the magnitude of the magnetic flux density reaches its maximum value before it reaches its minimum value as the particle passes through the magnetic field within the detection zone, the amplitude of the maximum value so reached, as well as the time in which it is reached, will vary with the particular ferromagnetic metal, as well as with its particle size. An examination of FIGS. 4 and 5 will show the differences in the change patterns measured for stainless steel and chrome-plated zinc, respectively.

Similarly, although all nonferromagnetic, nonferrous metals will exhibit the change pattern described herein for such materials, wherein the magnitude of the magnetic flux density reaches its minimum value before it reaches its maximum value as the particle passes through the magnetic field within the detection zone, the amplitude of the minimum value so reached, as well as the time in which it is reached, will vary with the particular nonferromagnetic, nonferrous metal, as well as with its particle size. An examination of FIGS. 6–9 will show the differences in the change patterns measured for aluminum, copper, lead and zinc, respectively. These differences will be due in large part to the differences in electrical conductivity among these metals.

In separating a preselected metal fraction comprised of a single metal, preferred results may be obtained in the practice of the invention if the size of the particle which has been detected in the detection zone is measured or determined, and the change pattern for the particular metal is predetermined based in part on the size parameters so obtained. This is due to the fact that the magnitude of the eddy currents induced in a metallic particle by interaction with a static magnetic field will depend in part on the size and shape of the particle. In addition, the magnitude of the increase in the magnetic flux density of the field in the vicinity of a ferromagnetic particle, caused by its higher magnetic permeability, will also depend somewhat on the particle size. In the practice of the preferred embodiment of FIG. 1, it has been found that the ratio of the signal strength obtained from the Hall-effect sensor to the height of the particle can be useful in determining the change pattern to be selected for the particular metal. The "height" referred to herein is that dimension of the particle which is presented to the infrared sensor and the Hall-effect sensor along the direction of travel of the particle through the detection zone. This height can be determined by measuring the period of time that the particle is seen by the infrared sensor and the speed at which the particle passes through the detection zone. In the embodiment of FIG. 1, the particle speed through the detection zone will be relatively constant. It will depend upon the distance traveled by the particles from the end of conveyor 20 to magnetic-field assembly 28, the acceleration of gravity and the effects of friction imparted to the particles by slide 22.

The magnitude of the change in the magnetic flux density caused by the passage of a particle of measured height through the detection zone can be mathematically adjusted so as to compare to a reference-standard change pattern for a particle of known height comprised of the metal to be selected, in order to take into account the size of the particle in determining how the change pattern measured for the particle compares to the predetermined change pattern.

Preferred results may also be obtained, in separating a preselected metal fraction comprised of a single nonferromagnetic, nonferrous metal, wherein the particles within the stream are treated prior to their passage through the detection zone so that the thickness of the particles is controlled. Changes in the magnetic flux density due to induced eddy currents will be more readily measured where the particles are treated so that their thickness is less than about 50% of the skin depth for such particles. As used herein, the "thickness" of a particle is the dimension that is presented perpendicular to the magnetic field as the particle passes therethrough. Skin depth is defined as $$\delta = \sqrt{\frac{2}{\omega\mu\sigma}}$$

where $\omega = 2\pi$ times the frequency of excitation, $\mu$ = permeability of the material, and $\sigma$ = conductivity of the material.

For the non-magnetic metals most commonly encountered at a commercial recycling center or a municipal waste processing facility, the skin depth is no greater than about 0.75 centimeters.

Referring again to the embodiment of FIG. 3, the digital computer is utilized to compare the changes measured in the magnetic flux density of the magnetic field as a particle passed through the detection zone with a predetermined change pattern for the preselected metal fraction, according to the principles disclosed herein. A personal computer with a microprocessor operating at 33 MHz can be utilized to make 30 such comparisons per second, in order to allow for separation of materials from a stream moving at conveyor speeds commonly in use at commercial recycling centers and municipal waste processing facilities.

Once the change in magnetic flux density caused by a particle has been determined to meet the criteria of the predetermined change pattern, the digital computer of FIG. 3 can send a digital signal through a conventional digital/analog (D/A) converter to a conventional solenoid valve for operation to separate the particle from the stream.

According to the preferred embodiment of FIG. 1, valve 30*a* may be actuated to emit a jet of fluid such as air, or more preferably water, in order to separate from the stream a particle whose passage through the detection zone changed the magnetic flux density of the field according to the predetermined change pattern for a preselected metal fraction, such as ferromagnetic metals, for example, or more particularly, stainless steel. If valve 30*a* is actuated to separate a particle from the stream, the particle will be moved out of the stream by the jet of fluid and its path somewhat controlled by associated splitter 32*a* to deposit it into collecting bin 34*a*. Similarly, valve 30*b* may be actuated at a slightly later time to separate a particle which has been identified according to a second preselected change pattern, such as for particle of chrome-plated zinc. A jet of fluid from valve 30*b* will direct the particle across splitter 32*b* to deposit it into collecting bin 34*b*. Other valves 30c–*f*, splitters 32c–*f* and associated bins 34c–*f* may be utilized similarly to separate other fractions from the stream, such as those of aluminum, copper, lead and zinc. What remains in the stream, comprised of dielectric materials and non-selected metals, will fall into bin 35 for collection.

It should be understood that a simpler arrangement, utilizing fewer valves, splitters and collecting bins, may be employed in the practice of the invention if it is desired to make fewer separations. For example, it may be desirable, in a particular installation, to separate ferromagnetic metals and nonferromagnetic, nonferrous metals from the stream. In such a circumstance, only two valves and associated splitters would be required, and three collecting bins (including one for materials not selected).

Although this description contains many specifics, these should not be construed as limiting the scope of the invention but as merely providing illustrations of some of the presently preferred embodiments of this invention. Thus, the invention, as described herein, is susceptible to various modifications and adaptations, and the same are intended to be comprehended within the meaning and range of equivalents of the appended claims.

What is claimed is:

1. A method for separating a preselected metal fraction which is not strongly ferromagnetic from a stream of discrete particles containing a plurality of metals, which method comprises:

(a) establishing a detection zone within the stream of particles;

(b) establishing within the detection zone a static magnetic field which is of insufficient strength to induce in the particles of metal in the stream an opposing magnetic field of such strength as to cause the particles in the stream to move;

(c) detecting the presence of a particle within the detection zone;

(d) measuring changes in the magnetic flux density of the field as the particle passes through the detection zone;

(e) comparing the changes measured in the magnetic flux density of the field as the particle passed through the detection zone with a predetermined change pattern for the preselected metal fraction; and (f) separating from the stream any particle whose passage through the detection zone changed the magnetic flux density of the field according to the predetermined change pattern.

2. The method of claim 1, wherein the static magnetic field is established by locating a permanent magnet within the detection zone.

3. The method of claim 1, wherein a jet of fluid is utilized to separate from the stream a particle whose passage through the detection zone changed the magnetic flux density of the field according to the predetermined pattern.

4. The method of claim 1, wherein the particles within the stream are constrained from tumbling as they pass through the detection zone.

5. The method of claim 4, wherein the particles are constrained from tumbling by passing them down a slide and through the detection zone.

6. The method of claim 1, wherein the detection zone is established:

(a) by locating an infrared sensor, comprised of an infrared emitter and an infrared detector, adjacent to the stream of particles, in order to detect the presence of a particle as the particle passes through the infrared beam of the infrared sensor; and (b) by locating a Hall-effect sensor adjacent to the stream of particles, in order to measure the changes that occur in the magnetic flux density of the field as the particle passes in the vicinity of the Hall-effect sensor.

7. The method of claim 6, wherein the Hall-effect sensor is located within a distance of approximately 1.5 centimeters from the stream of particles near the centerline of the static magnetic field, and the field strength of the static magnetic field is about 1200 gauss in the vicinity of the Hall-effect sensor.

8. The method of claim 1, wherein the preselected metal fraction comprises nonferromagnetic, nonferrous metals.

9. The method of claim 8, wherein a Hall-effect sensor is utilized to measure the change in the magnetic flux density of the field which is caused by the eddy currents induced in the particle within the detection zone during the time that the particle is within the detection zone.

10. The method of claim 8, wherein a particle is separated from the stream if its passage through the detection zone changes the magnetic flux density of the field such that the magnitude of the magnetic flux density during the time of passage of the particle through the detection zone reaches its minimum value before it reaches its maximum value.

11. The method of claim 1, wherein the size of the particle which has been detected in the detection zone is measured or determined and the change pattern for the preselected metal fraction is predetermined based in part on the size parameters so obtained, before the changes measured in the magnetic flux density of the field as the particle passed through the detection zone are compared with the predetermined change pattern.

12. The method of claim 11, wherein the particles within the stream are treated prior to their passage through the detection zone so that the thickness of the particles is no greater than about 0.75 centimeters.

13. The method of claim 11, wherein the thickness of the metallic particles in the stream is less than about 50% of the skin depth for such particles.

14. The method of claim 13, wherein the preselected metal fraction comprises a nonferromagnetic, nonferrous metal selected from the group consisting of aluminum, copper, lead and zinc.

15. The method of claim 1, wherein the preselected metal fraction comprises metals which are ferromagnetic, but not strongly so.

16. The method of claim 15, wherein a particle is separated from the stream if its passage through the detection zone changes the magnetic flux density of the field such that the magnitude of the magnetic flux density during the time of passage of the particle through the detection zone reaches its maximum value before it reaches its minimum value.

17. The method of claim 1, wherein a plurality of overlapping detection zones are established within the stream of particles, and a static magnetic field is established within and across the detection zones.

18. The method of claim 17, wherein a plurality of permanent magnets are arranged in close proximity on a backing plate of high-magnetic-permeability material, to establish a static magnetic field of overlapping components within and across the detection zone.

19. A method for separating a preselected metal fraction which is not strongly ferromagnetic from a stream of discrete particles containing a plurality of metals, which method comprises:

(a) establishing a detection zone within the stream of particles by locating an infrared sensor and a Hall-effect sensor at locations adjacent to the stream of particles;

(b) establishing within the detection zone, by locating a rare-earth permanent magnet therein, a static magnetic field which is of insufficient strength to induce in the particles of metal in the stream an opposing magnetic field of such strength as to cause the particles in the stream to move;

(c) constraining the particles from tumbling as they pass through the detection zone;

(d) detecting the presence of a particle within the detection zone by detecting its passage through the infrared beam of the infrared sensor;

(e) utilizing the Hall-effect sensor to measure the changes in the magnetic flux density of the field as the particle passes in the vicinity of the Hall-effect sensor through the detection zone;

(f) comparing the changes measured in the magnetic flux density of the field as the particle passed through the detection zone with a predetermined change pattern for the preselected metal fraction; and (g) utilizing a jet of fluid to separate from the stream any particle whose passage through the detection zone changed the magnetic flux density of the field according to the predetermined change pattern.

20. A method for separating a plurality of preselected metal fractions from a stream of discrete particles containing a plurality of metals that are not strongly ferromagnetic, which method comprises:

(a) establishing a detection zone within the stream of particles;

(b) establishing within the detection zone a static magnetic field which is of insufficient strength to induce in the particles of metal in the stream an opposing magnetic field of such strength as to cause the particles in the stream to move;

(c) detecting the presence of a particle within the detection zone;

(d) measuring changes in the magnetic flux density of the field as the particle passes through the detection zone;

(e) determining the size of the particle;

(f) comparing the changes measured in the magnetic flux density of the field as the particle passed through the detection zone with a first predetermined change pattern for metals that are ferromagnetic, but not strongly so, a second predetermined change pattern for aluminum, a third predetermined change pattern for copper, a fourth predetermined change pattern for lead, and a fifth predetermined change pattern for zinc;

(g) separating from the stream into a first fraction any particle whose passage through the detection zone changes the magnetic flux density of the field such that an increase in the magnetic flux density of the field will occur during the time of passage of the particle through the detection zone before a decrease in the magnetic flux density of the field occurs;

(h) separating from the stream into a second fraction any particle whose passage through the detection zone changes the magnetic flux density of the field according to the predetermined change pattern for aluminum;

(i) separating from the stream into a third fraction any particle whose passage through the detection zone changes the magnetic flux density of the field according to the predetermined change pattern for copper;

(j) separating from the stream into a fourth fraction any particle whose passage through the detection zone changes the magnetic flux density of the field according to the predetermined change pattern for lead; and (k) separating from the stream into a fifth fraction any particle whose passage through the detection zone changes the magnetic flux density of the field according to the predetermined change pattern for zinc.

* * * * *